US007897315B2

(12) United States Patent
Takemoto et al.

(10) Patent No.: US 7,897,315 B2
(45) Date of Patent: Mar. 1, 2011

(54) BASE TUBE FOR ELECTROPHOTOGRAPHIC PHOTOCONDUCTIVE MEMBER, ELECTROPHOTOGRAPHIC PHOTOCONDUCTIVE MEMBER USING THE SAME, METHOD FOR PRODUCING THE SAME

(75) Inventors: Hiroshi Takemoto, Osaka (JP); Sakae Saito, Osaka (JP)

(73) Assignee: Kyocera Mita Corporation (JP)

( * ) Notice: Subject to any disclaimer, the term of this patent is extended or adjusted under 35 U.S.C. 154(b) by 861 days.

(21) Appl. No.: 11/893,903

(22) Filed: Aug. 17, 2007

(65) Prior Publication Data

US 2008/0044202 A1 Feb. 21, 2008

(30) Foreign Application Priority Data

Aug. 18, 2006 (JP) ..... 2006-223477

(51) Int. Cl.
*G03G 5/00* (2006.01)

(52) U.S. Cl. ..... 430/69; 430/127; 399/159; 428/585

(58) Field of Classification Search ..... 430/69, 430/127; 399/159; 428/585
See application file for complete search history.

(56) References Cited

U.S. PATENT DOCUMENTS 4,271,240 A * 6/1981 Braun ..... 428/580
5,362,588 A * 11/1994 Yoshihara et al. ..... 430/69
5,518,854 A * 5/1996 Yu et al. ..... 430/133
7,618,759 B2 * 11/2009 Nishimura ..... 430/69

FOREIGN PATENT DOCUMENTS

JP 2003-149842 5/2003
JP 2003-149843 5/2003

* cited by examiner

*Primary Examiner*—Mark A Chapman
(74) *Attorney, Agent, or Firm*—Gerald E. Hespos; Michael J. Porco

(57) ABSTRACT

A base tube for an electrophotographic photoconductive member, is provided with a cylindrical body on which a photoconductive layer is formed; and a first slanting portion formed on a peripheral surface of an end portion of the cylindrical body, and slanting inward toward an end face of the end portion with respect to an axis of the cylindrical body. An axial length of the first slanting portion of the cylindrical body is within a range of 0.3 to 5 mm.

15 Claims, 11 Drawing Sheets

BASE TUBE FOR ELECTROPHOTOGRAPHIC PHOTOCONDUCTIVE MEMBER, ELECTROPHOTOGRAPHIC PHOTOCONDUCTIVE MEMBER USING THE SAME, METHOD FOR PRODUCING THE SAME

BACKGROUND OF THE INVENTION

1. Field of the Invention

The present invention relates to a base tube for an electrophotographic photoconductive member, an electrophotographic photoconductive member using the same, and a method for producing the same. In particular, it relates to a base tube for an electrophotographic photoconductive member that is resistant to liquid retention to prevent bottom-end foaming from occurring due to the liquid retention in forming of a photoconductive layer, an electrophotographic photoconductive member using the same, and a method for producing the same.

2. Description of the Related Art

Generally, cylindrical base tubes, for example, of a metal, have been used as a base part for an electrophotographic photoconductive member. An electrophotographic photoconductive member is produced by forming a photoconductive layer containing a binder resin, a charge generating agent, a charge carrying agent, and others on the peripheral surface of such a base tube.

The method for forming a photoconductive layer usually includes the following steps:

(1) a coating step of coating a photoconductive-layer-coating solution on the peripheral surface of the base tube by immersing a base tube into a photoconductive-layer-coating solution prepared by dissolving a binder resin, a charge generating agent, a charge carrying agent, and others in an organic solvent, (2) a drying step of drying the coated photoconductive-layer-coating solution, and (3) a bottom end processing step of removing the part of the photoconductive layer on the bottom end by immersing the bottom end of the base tube previously inserted in the photoconductive-layer-coating solution into a solvent dissolving the photoconductive layer.

The bottom end processing step is carried out to ensure communication between the end of the base tube and a flange having a ground piece.

However, in the coating step, there has been observed a phenomenon of the photoconductive-layer-coating solution remaining at the bottom end of the base tube by the surface tension of the photoconductive-layer-coating solution when the base tube is lifted up from the photoconductive-layer-coating solution, (hereinafter, referred to as "liquid retention"). The liquid retention, in turn, lead to hindrance of flow of the photoconductive-layer-coating solution, causing a problem that air bubbles are contained in the photoconductive-layer-coating solution being solidified in the region close to the bottom of the base tube without being discharged downward (hereinafter, referred to as "bottom-end foaming").

To solve the problems above, a base tube for an electrophotographic photoconductive member is formed with an end portion so modified in shape as to be resistant to liquid retention is proposed, for example, in Japanese Unexamined Patent Publication Nos. 2003-149842(D1) and 2003-149843 (D2).

More specifically, literature D1 discloses a base tube 200 for an electrophotographic photoconductive member, having tapered projections 201 and tapered dents 202 formed continuously on the end face at one end portion 200' of the cylindrical base tube 200 in an axial direction, as shown in FIG. 11A.

Alternatively, literature D2 discloses a base tube 210 for an electrophotographic photoconductive member, having slits 211 formed in an end portion 210' of the cylindrical base tube 210 in the axial direction, as shown in FIG. 11B.

However, the base tubes for an electrophotographic photoconductive member described in literatures D1 and D2 could prevent liquid retention to some extent by improving the efficiency of dropwise discharge of the photoconductive-layer-coating solution, but the efficiency is still insufficient.

In addition, the shape of the end portion of the base tube is so complicated that great amounts of labor and cost are needed for forming into such a particular shape, and thus, the methods had a problem of economical disadvantage.

After intensive studies to solve the problems above, the inventors have found that it is possible to prevent liquid retention at a base tube end portion and bottom-end foaming caused by the liquid retention effectively, by forming a particular slanting portion on part of the cylindrical base tube, and completed the present invention.

SUMMARY OF THE INVENTION

An object of the present invention is to provide a base tube for an electrophotographic photoconductive member which is simple in configuration and can prevent liquid retention and bottom-end foaming caused by the liquid retention at an end portion thereof effectively, an electrophotographic photoconductive member using the same, and an easy method for producing the same.

According to an aspect of the present invention, a base tube for an electrophotographic photoconductive member, comprises a cylindrical body on which a photoconductive layer is formed and a first slanting portion formed on a peripheral surface of an end portion of the cylindrical body, and slanting inward toward an end face of the end portion with respect to an axis of the cylindrical body, an axial length of the first slanting portion of the cylindrical body being within a range of 0.3 to 5 mm.

According to another aspect of the present invention, an electrophotographic photoconductive member, comprises a base tube for an electrophotographic photoconductive member, and a photoconductive layer containing a charge generating agent, a charge carrying agent, and a binder resin, and formed on a peripheral surface of the base tube. The base tube includes a cylindrical body on which a photoconductive layer is formed, and a first slanting portion formed on a peripheral surface of an end portion of the cylindrical body, and slanting inward toward the end face with respect to an axis of the cylindrical body, an axial length of the first slanting portion of the cylindrical body being within a range of 0.3 to 5 mm.

According to yet another embodiment of the present invention, a method for producing an electrophotographic photoconductive member, comprises the steps of:

(a) preparing a cylindrical base tube having a slanting portion on an end portion thereof, and the slanting portion slanting toward the end face of the end portion with respect to an axis of the cylindrical base tube and having an axial length of 0.3 to 5 mm;

(b) preparing a photoconductive-layer-coating solution containing a charge generating agent, a charge carrying agent, and a binder resin;

(c) immersing the cylindrical base tube into the photoconductive-layer-coating solution with the end portion having the slanting portion facing downward to coat the cylindrical base tube with the photoconductive-layer-coating solution;

(d) forming a photoconductive layer by drying the photoconductive-layer-coating solution coated on the peripheral surface of the cylindrical base tube; and (e) removing a part of the photoconductive layer on the end portion of the cylindrical base tube.

DETAILED DESCRIPTION OF THE PREFERRED EMBODIMENTS

First Embodiment

In the first embodiment, a base tube for an electrophotographic photoconductive member will be described in detail. The base tube comprises a cylindrical body on which a photoconductive layer is formed and a first slanting portion formed on a peripheral surface of an end portion of the cylindrical body, and slanting inward toward the end face with respect to an axis of the cylindrical body, wherein an axial length of the first slanting portion of the cylindrical body is within a range of 0.3 to 5 mm.

Hereinafter, components for the base tube for an electrophotographic photoconductive member in the first embodiment will be described respectively.

1. Basic Configuration

Figure 1:
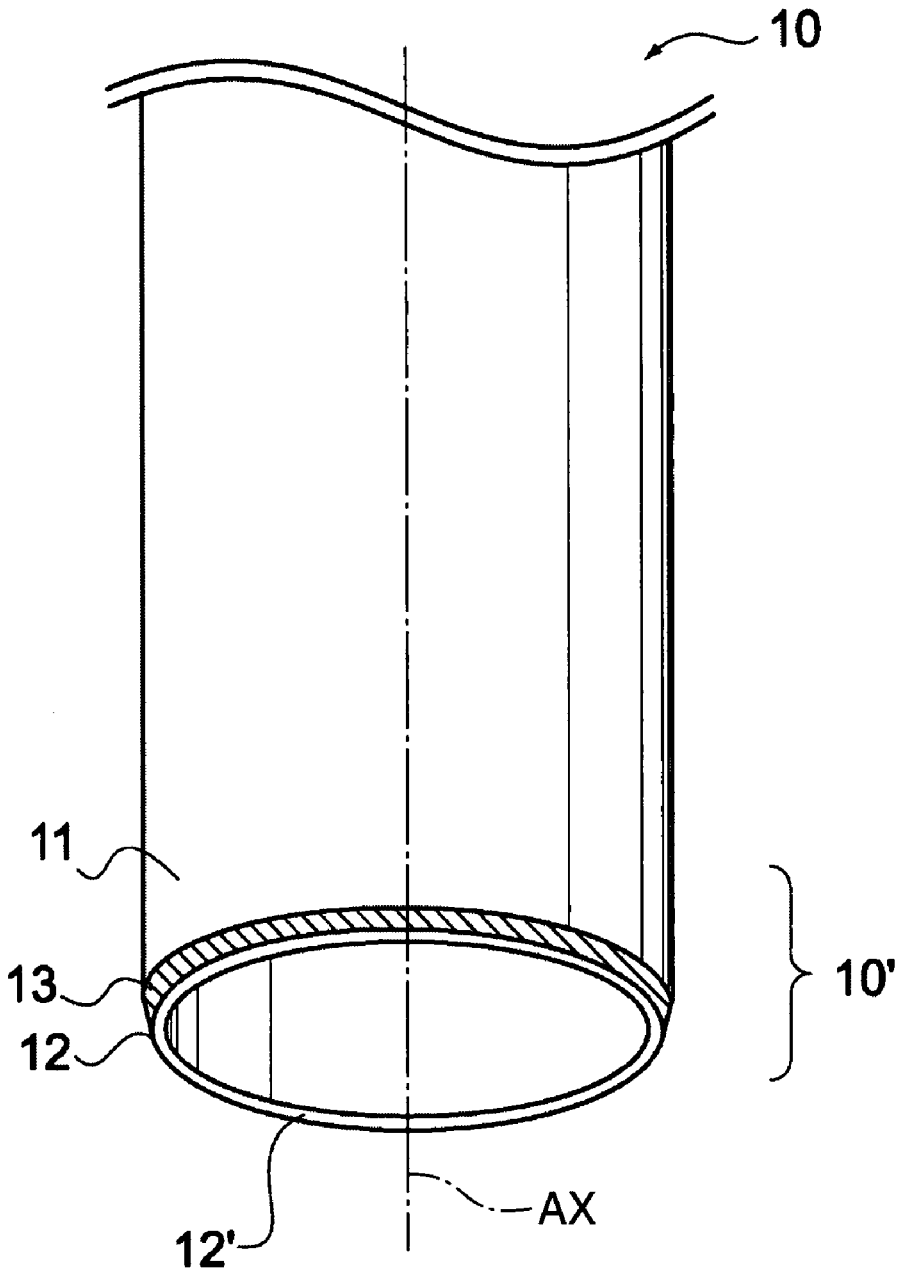
FIG. 1 is a partially perspective view illustrating a base tube for an electrophotographic photoconductive member according to an embodiment of the present invention.

As shown in FIG. 1, the base tube 10 for an electrophotographic photoconductive member in the present embodiment has a slanting portion 13 (first slanting portion) slanting toward the end face 12' in the direction of the axis AX of the base tube 10, on the peripheral surface of an end portion 10' of the cylindrical body 10 (hereinafter, referred to simply as "base tube 10").

The reason for forming such a slanting portion 13 is that it is possible, by forming such a region at the extreme end 12 of the base tube 10, to prevent liquid retention and make photoconductive-layer-coating solution drop smoothly, when the base tube is immersed into and lifted up from the photoconductive-layer-coating solution. The slanting portion 13 will be described below in detail, together with the mechanism of occurrence and prevention of the liquid retention above.

Various conductive materials may be used as a material for the base tube 10. Examples thereof include metals such as iron, aluminum, copper, tin, platinum, silver, vanadium, molybdenum, chromium, cadmium, titanium, nickel, palladium, indium, stainless steel, and brass; plastic materials carrying a film of the metal described above formed by vapor deposition or lamination; glasses coated, for example, with alumite, aluminum chloride, tin oxide, or indium oxide; and the like.

However, the base tube may be surface-roughened by a method such as etching, anodic oxidation, wet blasting, sandblasting, rough machining, or centerless machining, for prevention of occurrence of interference fringe.

When the base tube is subjected, for example, to anodic oxidation, the surface may become non-conductive or semi-conductive, but, even in such a case, it may be use as the base tube, if a particular advantageous effect is obtained.

Figure 2A:
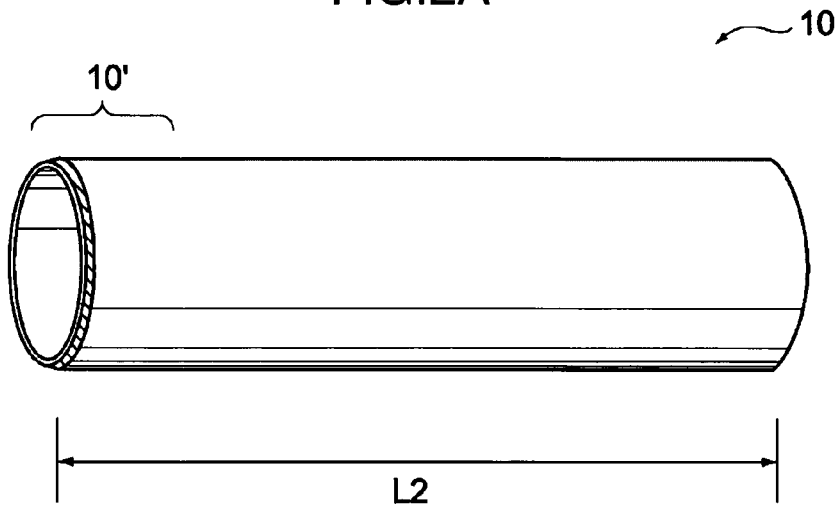
FIGS. 2A and 2B are a perspective view and a partial side view respectively illustrating a slanting portion formed on the base tube shown in FIG. 1.
Figure 2B:
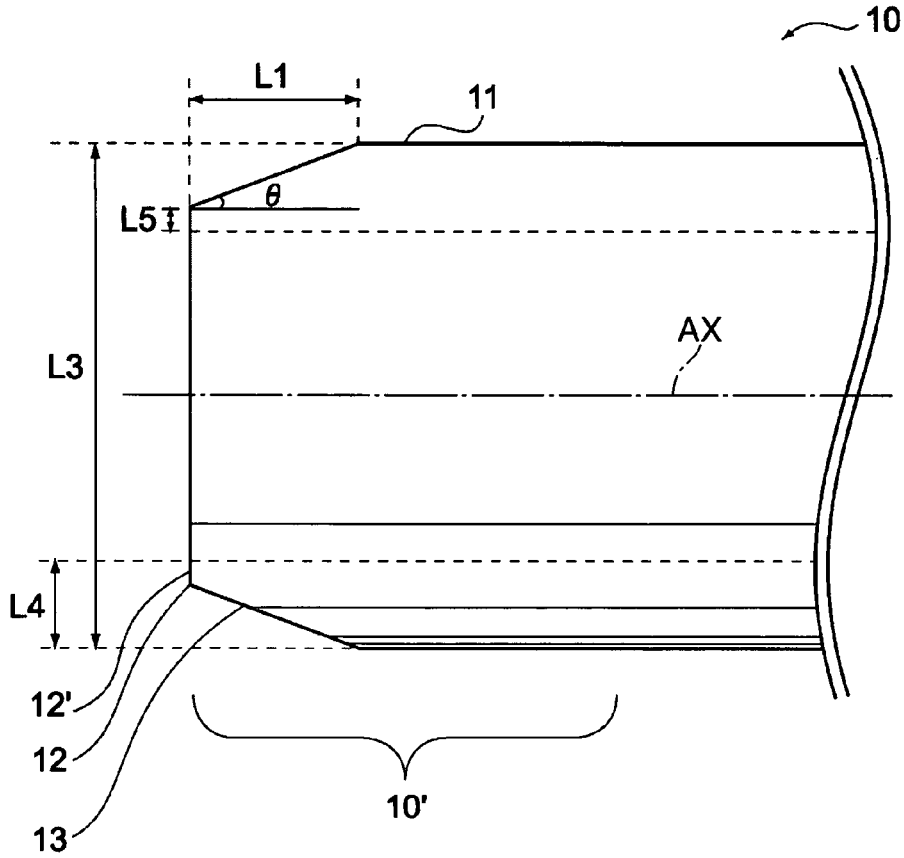

As shown in FIGS. 2A and 2B, the length (L2) of the base tube 10 is preferably from 150 to 300 mm, more preferably from 180 to 250 mm. The diameter (L3) of the base tube 10 is preferably from 10 to 60 mm, more preferably from 10 to 35 mm. The thickness (L4) of the base tube 10 is preferably from 0.5 to 3 mm, more preferably from 1 to 2 mm.

2. Slanting Portion (1) Length of Slanting Portion

As shown in FIG. 2B, the base tube 10 has the slanting portion 13 slanting inward toward the end face 12' in the direction of the axis AX of the base tube 10, on a peripheral surface of an end 10' of the base tube 10. The length (L1) of the slanting portion 13, as projected in the base-tube axis direction, is within a range of 0.3 to 5 mm.

This is because it is possible to prevent liquid retention more effectively and make the coating solution drop more smoothly, by controlling the length (L1) of the slanting portion within a range above. It is thus possible to prevent the bottom-end foaming caused by liquid retention effectively. It is also possible to increase the uniformity in thickness of the photoconductive layer and to raise the yield of the photoconductive-layer-coating solution and the solvent used in bottom-end processing.

This is because a slanting portion length of less than 0.3 mm, which leads to reduction in the area of the slanting portion, may prohibit effective prevention of liquid retention. On the other hand, a slanting portion length of more than 5 mm, which leads to reduction of the slanting angle of the slanting portion, may prohibit effectively prevention of liquid retention.

Accordingly, the length of the slanting portion is more preferably within a range of 0.5 to 3 mm, still more preferably within a range of 0.8 to 2 mm.

Hereinafter, the mechanism of occurrence and prevention of liquid retention will be described in more detail.

First, in coating a photoconductive-layer-coating solution on a base tube, generally used is a method for coating a photoconductive-layer-coating solution on the peripheral surface of a base tube by immersing the base tube in the photoconductive-layer-coating solution prepared by dissolving a binder resin, a charge generating agent, a charge carrying agent, and others in an organic solvent.

Figure 3:
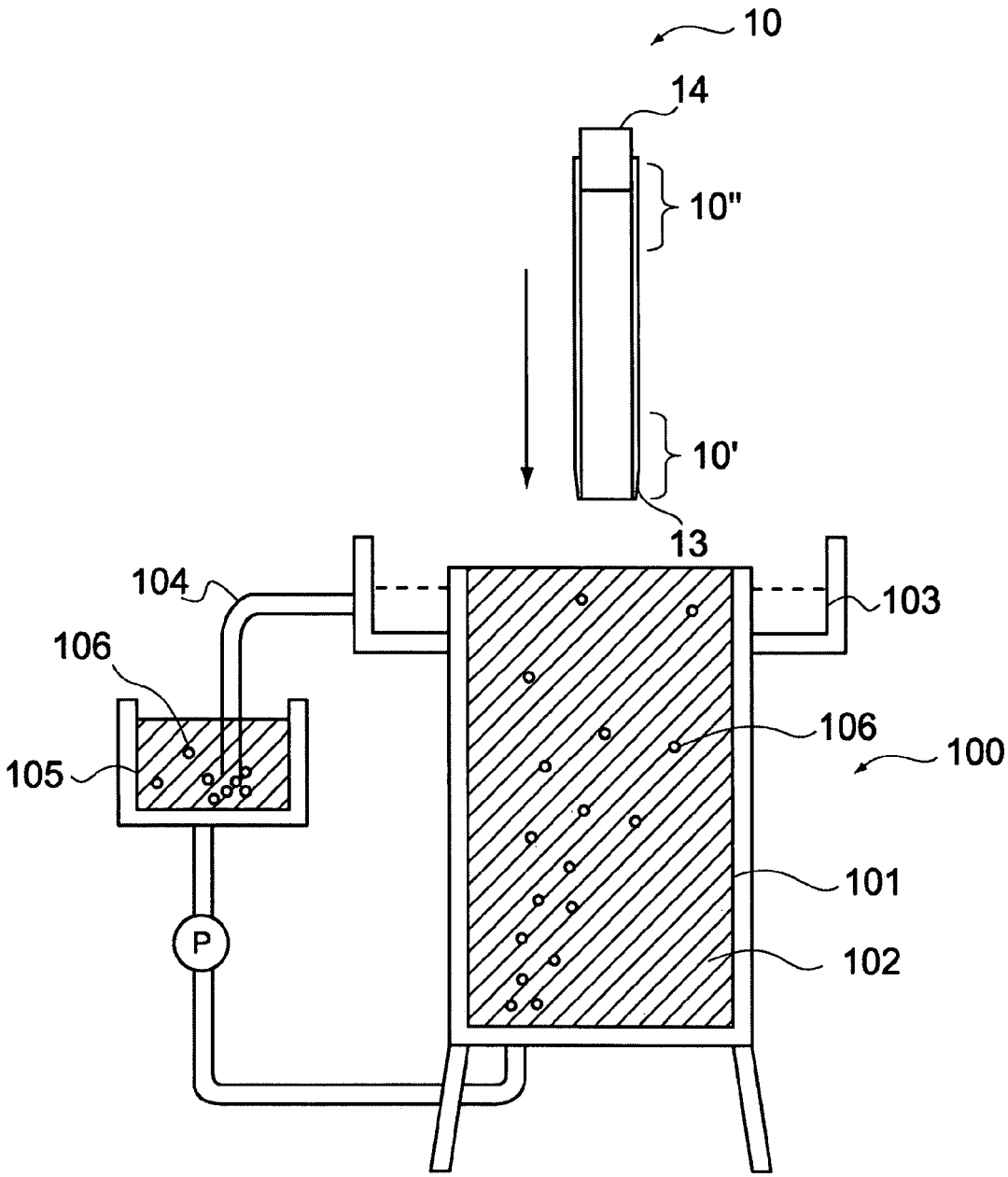
FIG. 3 is a schematic view explaining a step of coating a photoconductive-layer-coating solution.

More specifically, the coating is performed, for example, in a coating equipment 100 shown in FIG. 3. The coating operation is performed by filling a photoconductive-layer-coating solution 102 in a coating solution tank 101 of the coating equipment 100, immersing the base tube 10 with its one end portion 10' facing downward therein, and lifting up it therefrom.

A sealing stopper 14 is connected to the other end portion 10" of the base tube 10 for prevention of penetration of the photoconductive-layer-coating solution 102 into the internal space of the base tube 10. The base tube 10 having the slanting portion in the present embodiment is used, for example, as a base tube for an electrophotographic photoconductive member shown in FIG. 3.

Figure 4A:
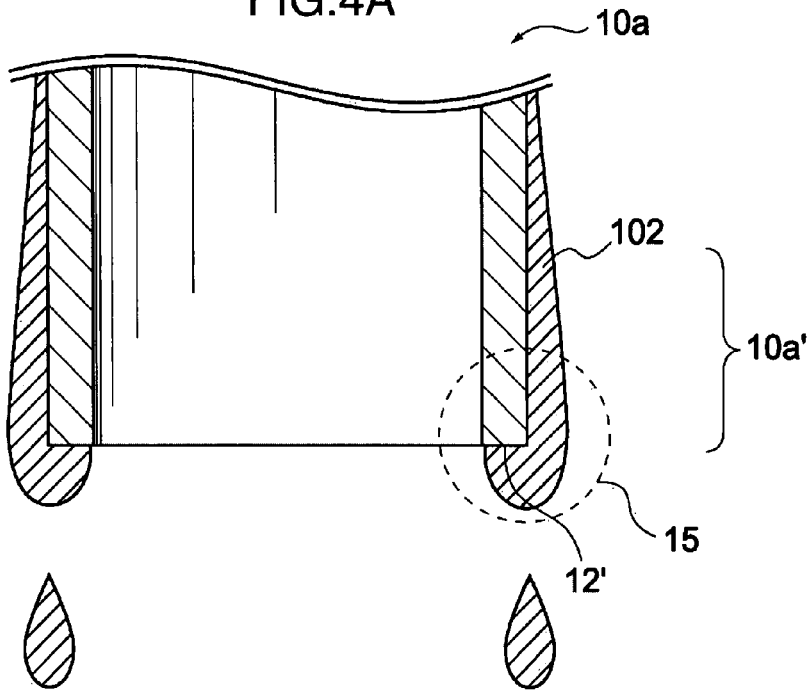
FIGS. 4A and 4B are partially sectional views showing the phenomenon of liquid retention.

However, conventional base tubes for an electrophotographic photoconductive member had a problem of liquid retention 15 shown in FIG. 4A, when lifted up from the photoconductive-layer-coating solution.

Such liquid retention 15 is a phenomenon caused by the influence of the surface tension of the photoconductive-layer-coating solution 102, in which the photoconductive-layer-coating solution 102 moves to the end face 12' of the base tube 10*a* for an electrophotographic photoconductive member and remains at the end portion 10*a*' of the base tube 10*a* by decrease of downward dropping efficiency.

Figure 5:
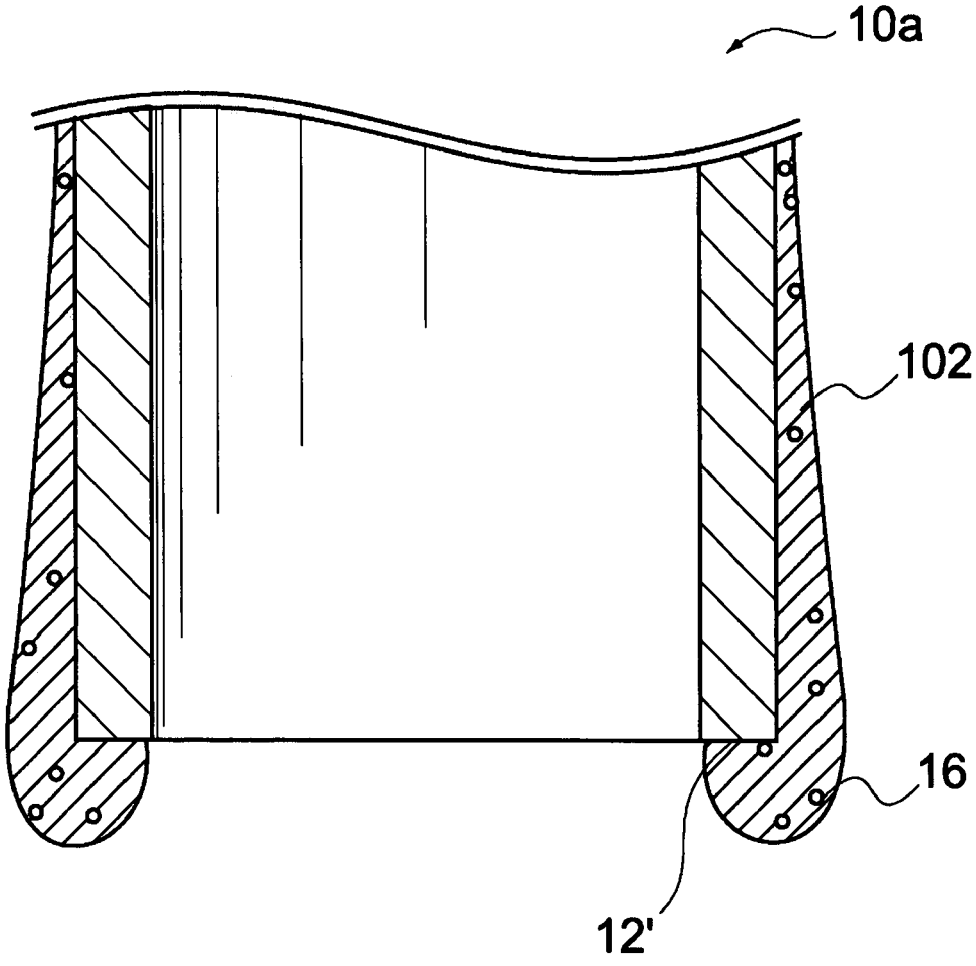
FIG. 5 is a partially sectional view showing the phenomenon of bottom-end foaming.

The liquid retention 15 often resulted in the problem of bottom-end foaming 16 in the photoconductive layer formed, as shown in FIG. 5. The bottom-end foaming 16 is a phenomenon that, as a result of the retention of the coating solution by liquid retention, air bubbles remaining in the photoconductive-layer-coating solution are solidified in the area close to the end portion of the base tube without downward flow.

As shown in FIG. 3, contamination of the photoconductive-layer-coating solution 102 with air bubbles 106 are known to occur during overflow of the photoconductive-layer-coating solution 102 from a coating solution tank 101 to an overflow tank 103 and during flow of the photoconductive-layer-coating solution 102 from a return pipe 104 into a circulation tank 105.

In addition, the liquid retention 15 also leads to thickening of the photoconductive layer at the bottom end of the base tube and fluctuation in thickness of the photoconductive layer, raising problems such as deterioration in image properties and elongation of the drying period in drying step.

It also leads to thickening of the photoconductive layer at the bottom end of the base tube, raising problems such as decrease of the yield of coating solution as well as the yield of the solvent used in the bottom end processing step described below.

Figure 4B:
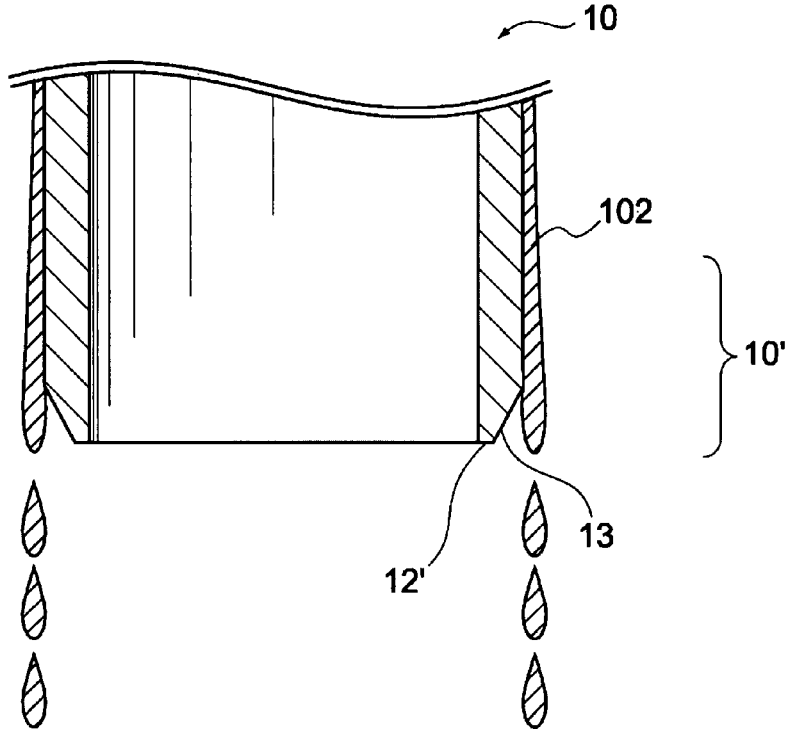

On the other hand, the base tube 10 in the present embodiment, which has a slanting portion 13 having a particular width on a peripheral surface of an end 10' of the base tube, prevents migration of the photoconductive-layer-coating solution 102 to the end face 12' of the base tube 10 and occurrence of the liquid retention, as shown in FIG. 4B.

Even when the photoconductive-layer-coating solution moves to the slanting portion 13 by surface tension, a force to push the photoconductive-layer-coating solution there downward is applied by the photoconductive-layer-coating solution flowing downward in the slanting portion 13, which is different from the end face 12'. As a result, the photoconductive-layer-coating solution, even when brought to the slanting portion 13, is pushed downward, dropwise before it reaches the end face 12'.

For that reason, the base tube 10 in the present embodiment prevents generation of the liquid retention more effectively and solves the problems described above such as the bottom-end foaming caused by liquid retention effectively.

Hereinafter, the relationship between the length of the slanting portion 13, as projected in the axis direction of the base tube, and the number of the bottom-end foams generated will be described with reference to FIG. 6.

Figure 6:
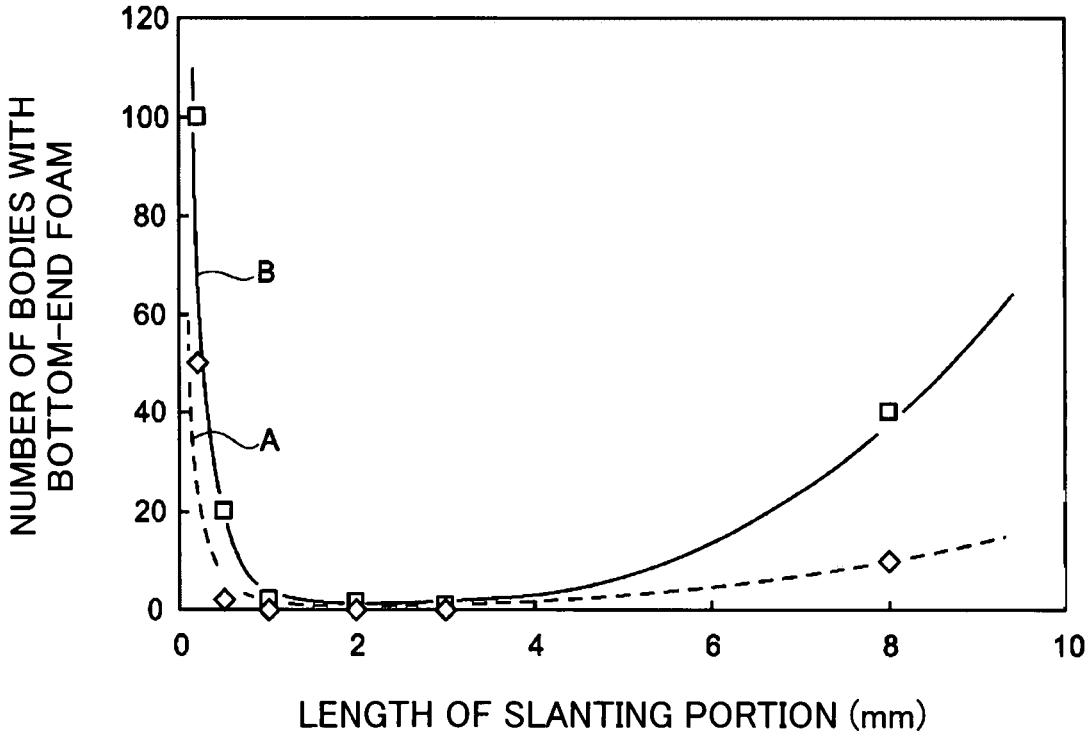
FIG. 6 is a graph showing a relationship between the length of the slanting portion and the bottom-end foaming.

In FIG. 6, the length (mm) of the slanting portion, as projected in the axis direction of the base tube 10, is plotted on the abscissa, while the number of electrophotographic photoconductive members having bottom-end foams generated per 1000 electrophotographic photoconductive members prepared, on the ordinate.

The characteristic curve A is obtained by using a photoconductive-layer-coating solution at a viscosity of 200 mPa·s, while the characteristic curve B, by using a photoconductive-layer-coating solution at a viscosity of 500 mPa·s. As apparent from the characteristic curves A and B, increase of the length (mm) of the slanting portion leads to critical change in the number of electrophotographic photoconductive members having bottom-end foams caused.

More specifically, both of the characteristic curves A and B, increase of the length (mm) of slanting portion from 0 to 0.3 mm leads to decrease in the number of the electrophotographic photoconductive members having bottom-end foams caused, and further increase to 0.5 mm leads to drastic decrease from at least 100 or more to 20 or less. Both of the characteristic curves A and B, the number of the electrophotographic photoconductive members having bottom-end foams generated is consistently lower when the length (mm) of the slanting portion is within a range of 0.5 to 5 mm, indicating that there is almost no bottom-end foaming. On the other hand, when the length (mm) of the slanting portion is larger than 5 mm, the number of the electrophotographic photoconductive members having bottom-end foams gradually increases at an increasing rate, and in particular of the characteristic curve B, the number of the electrophotographic photoconductive members having bottom-end foams generated increases to approximately 50 when the length (mm) of the slanting portion is 8 mm.

The characteristic curve B being located above the characteristic curve A is because of the fact that air bubbles remain in the photoconductive-layer-coating solution in greater amount when the photoconductive-layer-coating solution is more viscous.

In anyway, it is possible to prevent the bottom-end foaming effectively, by adjusting the length of the slanting portion within a range of 0.3 to 5 mm. In other words, it is possible to prevent bottom-end foaming, the cause of liquid retention, effectively.

The length of the slanting portion 13, as projected in the base-tube axis direction, is preferably made shorter than the length of the photoconductive layer removed by bottom-end processing. It is because it is possible to remove the photoconductive layer formed on the slanting portion having an uneven layer thickness reliably by solubilization, by making the length of the slanting portion shorter than the length of the photoconductive layer removed by the bottom-end processing.

The length of the photoconductive layer removed by the bottom-end processing is generally, approximately 0.5 to 5 mm, but the length of the slanting portion 13 is preferably made shorter by a range of 0.05 to 2 mm than the length of the photoconductive layer removed by the bottom-end processing.

(2) Slanting Angle

The angle to the axis AX of the base tube 10 in the slanting portion 13 is preferably within a range of 5 to 40°.

It is because it is possible to prevent occurrence of liquid retention more reliably and the bottom-end foaming caused by the liquid retention further more reliably, by adjusting the angle (θ) to the axis AX of the base tube 10 in the slanting portion 13 within a range above as shown in FIG. 2B.

When the angle to the axis of the base tube in the slanting portion is less than 5°, the photoconductive-layer-coating solution may reach the end face of the base tube for an electrophotographic photoconductive member, as it is not discharged in the slanting portion. As a result, the photoconductive-layer-coating solution moves to the end face, possibly generating liquid retention. On the other hand, when the angle to the axis of the base tube in the slanting portion is more than 40°, the difference in angle between the slanting portion and the end face becomes extremely small, possibly prohibiting the advantageous effect of the slanting portion.

Accordingly, the angle to the axis of the base tube in the slanting portion is more preferably within a range of 8 to 30°, still more preferably within a range of 10 to 20°.

(3) Thickness of Extreme End

The thickness of the extreme end 12 of the slanting portion 13 represented by (L5) in FIG. 2B is preferably within a range of 0.3 to 2 mm.

It is because it is possible to prevent occurrence of liquid retention more effectively and to retain the strength sufficiently at the end portion 10' of the base tube 10, by adjusting the thickness of the extreme end 12 of the base tube 10 in the range above.

It is because a thickness of the extreme end of the base tube at less than 0.3 mm may make the strength of the end portion of the base tube insufficient and the process of making the slanting portion for example by machining inefficient. It is because a thickness of the extreme end of the base tube at more than 2 mm may lead to migration of the photoconductive-layer-coating solution not discharged dropwise in the slanting portion, to the end face and occurrence of liquid retention.

Accordingly, the thickness of the extreme end of the base tube is more preferably within a range of 0.5 to 1.8 mm, still more preferably within a range of 0.7 to 1 mm.

(4) Shape of Slanting Portion

Figure 7A:
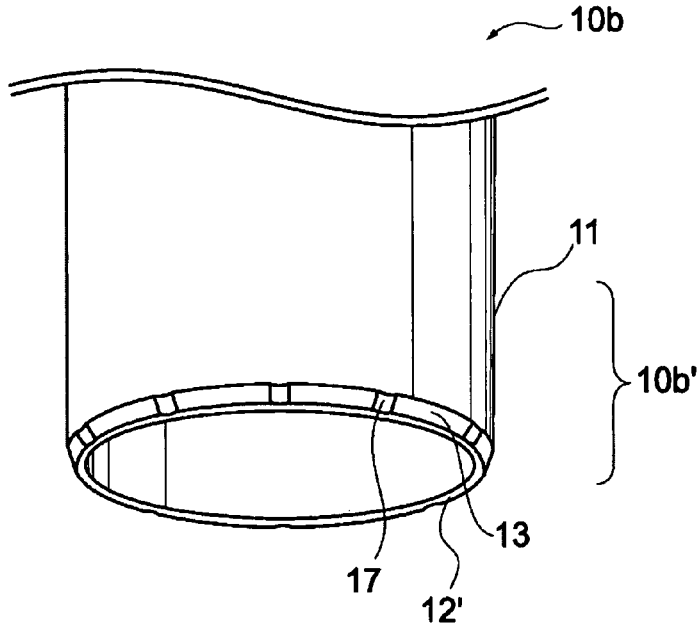
FIGS. 7A to 7C are partially perspective and sectional views illustrating slanting portions according to another embodiments of the invention.

As shown in FIG. 7A, the slanting portion 13 preferably has grooves 17 in the slanting surface.

It is because, with the grooves 17, the slanting portion 13 allows selective flow of the photoconductive-layer-coating solution into the grooves 17 after application and more efficient dropwise downward discharge of the photoconductive-layer-coating solution.

Thus, the selective flow of the photoconductive-layer-coating solution into the groove enhances the downward flow of the photoconductive-layer-coating solution in the groove. As a result, it is possible to prevent migration of the photoconductive-layer-coating solution onto the end face 12' more effectively.

The dimension such as width, depth, and gap of the groove 17 is not particularly limited, but, for example, the width of the groove 17 is preferably within a range of 0.5 to 5 mm, the depth, within a range of 0.1 to 1 mm, and the gap within a range of 0.5 to 10 mm.

Figure 7B:
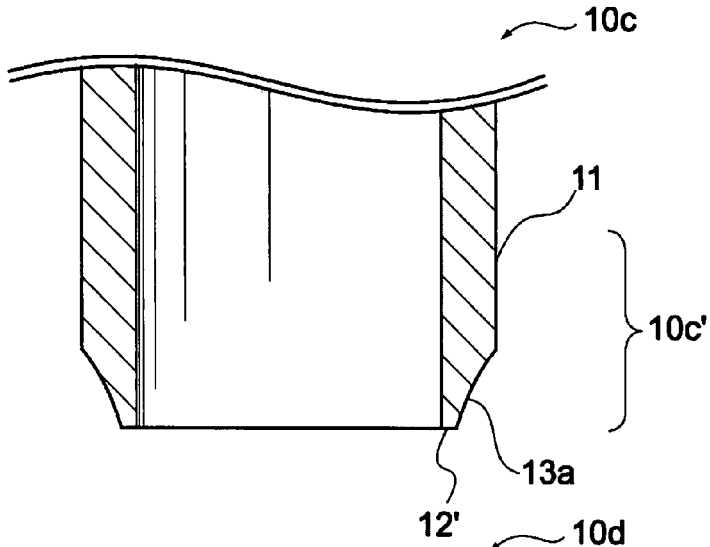

For example, as shown in FIG. 7B, the slanting portion 13*a* is preferably curved.

It is because, when the slanting portion 13*a* on the end portion base tube 10*c'* of the base tube 10*c* is curved, it is easier to adjust the difference in angle between the peripheral surface 11 other than that in the slanting portion 13*a* and the slanting portion 13*a* in a favorable range.

Accordingly, even when the condition of the photoconductive-layer-coating solution such as viscosity is changed, it is possible to prevent occurrence of liquid retention effectively, while keeping the length of the slanting portion and the thickness of the extreme end constant.

As a result, it is not necessary to modify the bottom end processing step or the step of fixing a flange onto the end portion of the base tube described below according to the length of the slanting portion and the thickness of the extreme end, and thus, to produce the electrophotographic photoconductive member more efficiently.

Figure 7C:
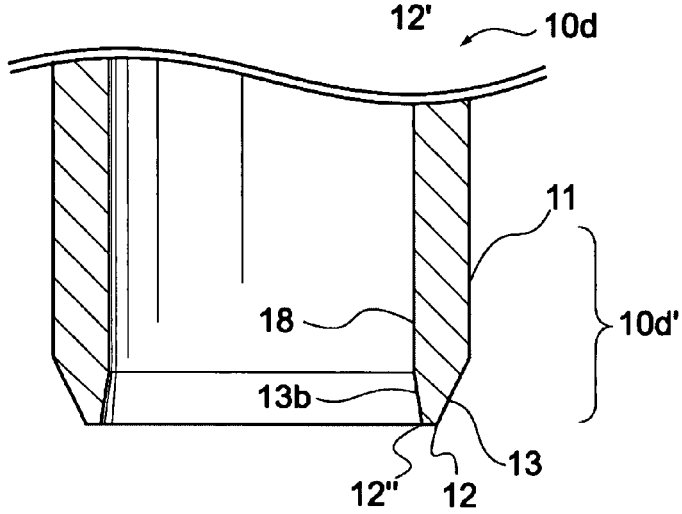

In addition, as shown in FIG. 7C, the internal surface 18 of the end portion 10*d'* has a slanting portion 13*b* (second slanting portion) close to the end face 12" slating outward or toward the peripheral surface 11 of the base tube 10*d*.

It is because presence of a particular slanting portion 13*b* also in the internal surface 18 of the end portion 10*d'* makes it possible to prevent liquid retention of the photoconductive-layer-coating solution deposited on the internal surface 18 of the base tube 10*d*, even when the photoconductive-layer-coating solution penetrates onto the internal surface of the base tube 10*d*.

Thus as described above, when the base tube is immersed in the photoconductive-layer-coating solution, for example, a sealing stopper 14 is fitted to the top end portion 10" of the base tube 10 for prevention of migration of the photoconductive-layer-coating solution 102 into the internal base tube 10, as shown in FIG. 3. However, the photoconductive-layer-coating solution 102 may penetrate into the space in the base tube 10, although small in amount, by the pressure of the photoconductive-layer-coating solution 102.

On the other hand, even in such a case, it is possible to prevent liquid retention of the photoconductive-layer-coating solution deposited on the internal surface of the base tube, by forming a particular slanting portion on the internal surface of the end portion 10'.

The length, slanting angle, and others of the slanting portion may be the same as those of the slanting portion on the peripheral surface of the base tube.

(5) Jig

Figure 8A:
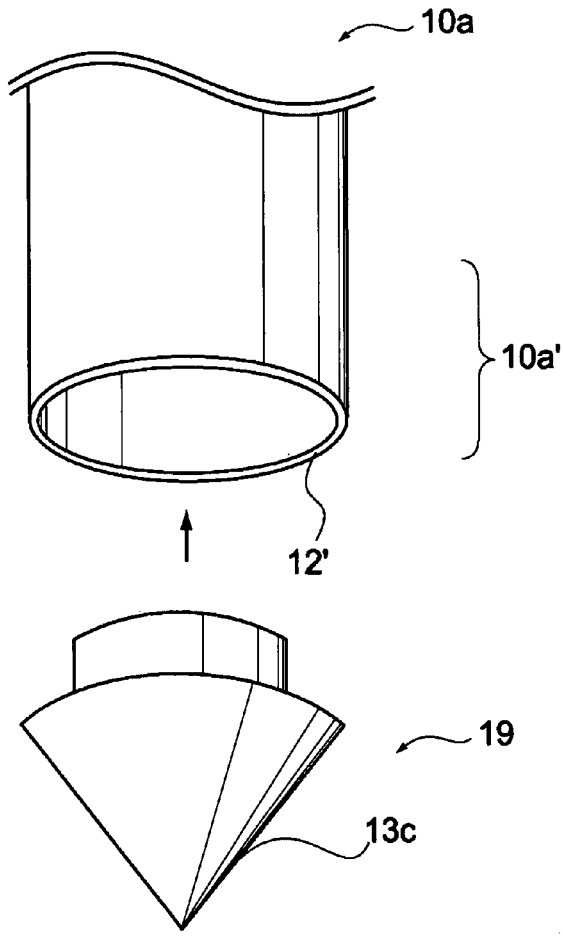
FIGS. 8A and 8B are partially perspective views illustrating a combination of a jig having a slanting portion with the base tube.
Figure 8B:
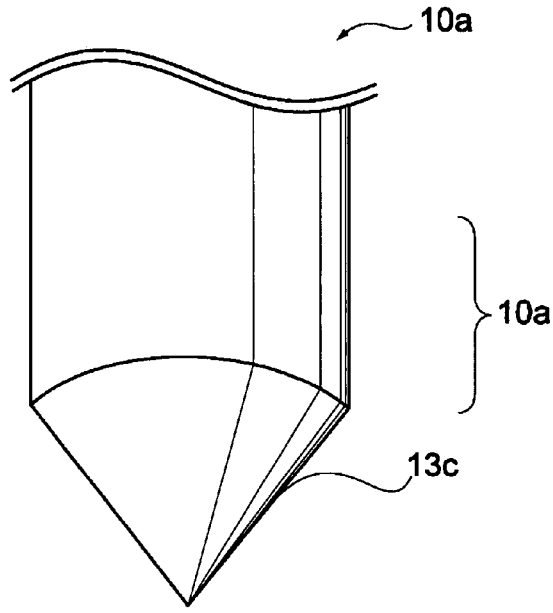

As shown in FIGS. 8A and 8B, instead of forming a slanting portion 13 on the peripheral surface of the base tube 10 as described above, the liquid retention and the bottom-end foaming may be prevented by fixing a jig 19 having a slanting portion 13*c* to a base tube 10*a* for an electrophotographic photoconductive member having no slanting portion.

It is because it is possible to control liquid retention and bottom-end foaming more easily, as there is no need for processing for forming a slanting portion on the base tube for an electrophotographic photoconductive member. Such a jig 19 may be used repeatedly, after the photoconductive-layer-coating solution is removed cleanly, which is advantageous from the point of cost.

Second Embodiment

An electrophotographic photoconductive member will be described in detail in the second embodiment. The electrophotographic photoconductive member in the present embodiment has a base tube for an electrophotographic photoconductive member and a photoconductive layer containing a charge generating agent, a charge carrying agent, and a binder resin, and formed on a peripheral surface of the base tube. The base tube includes a cylindrical body on which a photoconductive layer is formed and a slanting portion slanting toward the end face in the axis direction slanting portion of the cylindrical body formed on a peripheral surface of an end portion of the cylindrical body; and the length of the slanting portion (L1), as projected in the axis direction of the cylindrical body, is within a range of 0.3 to 5 mm.

Hereinafter, the electrophotographic photoconductive member in the second embodiment, excluding the description previously described in the first embodiment, will be described, primarily by taking a single-layer electrophotographic photoconductive member as an example.

1. Basic Configuration

Figure 9A:
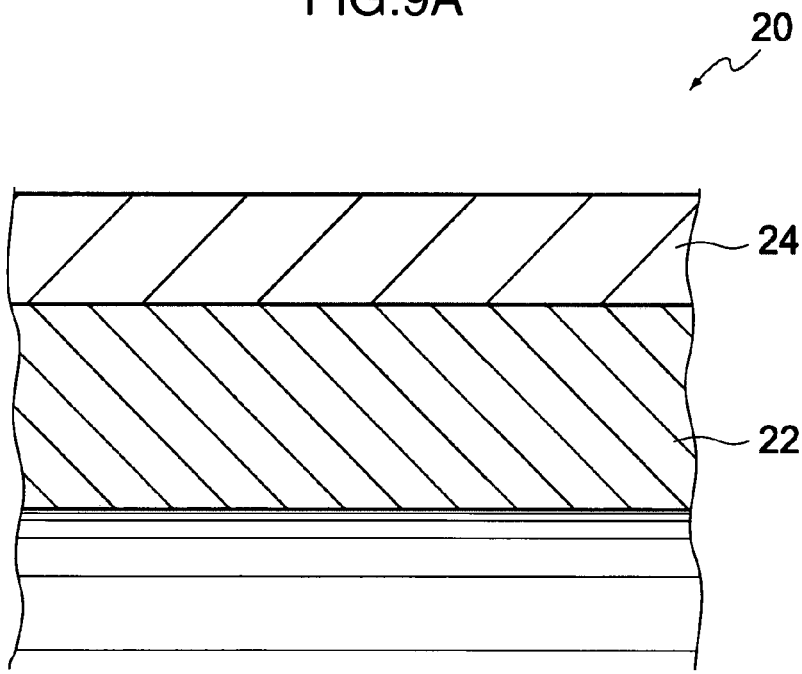
FIGS. 9A and 9B are partially sectional views showing a single photoconductive layer formed on the base tube.

As shown in FIG. 9A, in the basic configuration of the single-layer electrophotographic photoconductive member 20 in the present embodiment, a single photoconductive layer 24 containing a charge generating agent, a charge carrying agent, and a binder resin is preferably formed on a particular base tube, base material 22.

Figure 9B:
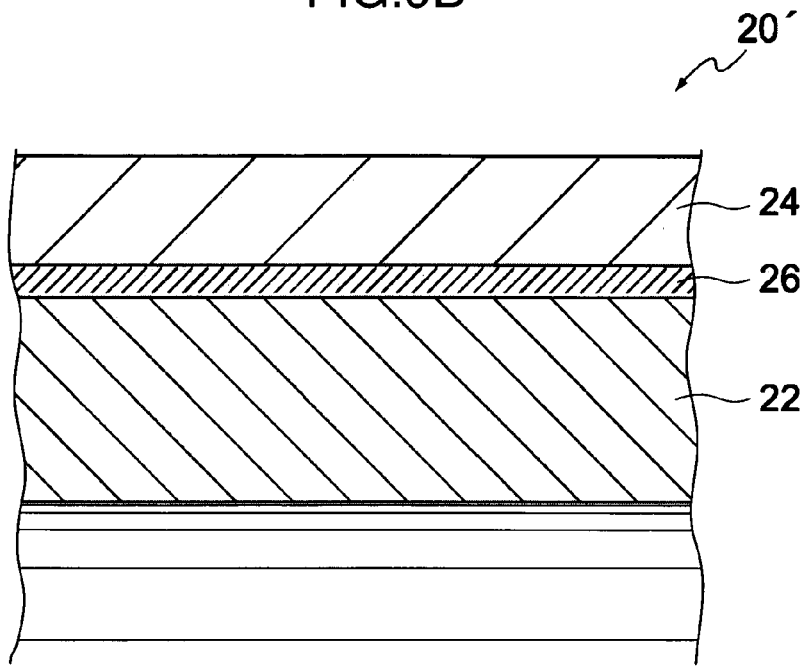

As exemplified in FIG. 9B, the single-layer photoconductive member 20' may have an additional intermediate layer 26 formed between the photoconductive layer 24 and the base material 22.

2. Base Material

A base tube for an electrophotographic photoconductive member having a slanting portion slanting inward toward the end face with respect to an axis of the base tube formed on a peripheral surface of an end portion of the base tube, wherein the length of the slanting portion (L1), as projected in the axis direction of the cylindrical body, is within a range of 0.3 to 5 mm is used as the base material 22 exemplified in FIGS. 9A and 9B.

It is because it is possible to obtain an electrophotographic photoconductive member having a photoconductive layer uniform in thickness with fewer bottom-end foaming caused by liquid retention, by using such a base tube having a particular slanting portion as the base material. It is thus possible to form a high-quality image consistently by using the electrophotographic photoconductive member according to the present invention.

3. Intermediate Layer

As shown in FIG. 9B, an intermediate layer 26 containing a particular binder resin may be formed on the base material 22.

It is because it is thus possible to raise the adhesiveness between the base material 22 and the photoconductive layer 24, prevent generation of interference fringe, by scattering the incident beam with a particular fine powder added to the intermediate layer 26, and prevent charge injection from the base material 22 to the photoconductive layer 24 during non-exposure, causes of high background soil and black spots. The fine powder is not particularly limited, if it is light scattering and dispersible, and examples thereof include white pigments such as titanium oxide, zinc oxide, zinc white, zinc sulfide, white lead, and lithopone; inorganic extender pigments such as alumina, calcium carbonate, and barium sulfate; fluoroplastic resin particles, benzoguanamine resin particles, styrene resin particles, and the like.

The layer thickness of the intermediate layer 26 is preferably within a range of 0.1 to 50 μm. It is because an excessively thick intermediate layer leaves large residual voltage on the photoconductive member surface, which may deteriorate the electrical properties. On the other hand, an excessively thin intermediate layer can not relax the surface irregularity of the base material sufficiently, prohibiting favorable adhesion between the base material 22 and the photoconductive layer 24.

Therefore, the thickness of the intermediate layer 26 is preferably within a range of 0.1 to 50 μm, more preferably within a range of 0.5 to 30 μm.

4. Photoconductive Layer

The photoconductive layer 24 may contain a binder resin, a charge generating agent, a positive hole carrying agent, and an electron carrying agent at a suitable ratio.

The binder resin favorably used is, for example, a polycarbonate resin; the favorable charge generating agent, titanylphthalocyanine; the favorable positive hole carrying agent, a triphenylamine compound; and the favorable electron carrying agent, an azo quinone compound or the like.

The thickness of the photoconductive layer 24 is preferably within a range of 5.0 to 100 μm. it is because a photoconductive-layer 24 thickness of less than 5.0 μm may make the mechanical strength of the electrophotographic photoconductive member insufficient. Alternatively, a photoconductive-layer 24 thickness of more than 100 μm may make the layer more separable from the base material or make it more difficult to form it uniformly. Therefore, the thickness of the photoconductive layer 24 is preferably within a range of 10 to 80 μm, more preferably within a range of 20 to 40 μm.

5. Laminated-Layer Electrophotographic Photoconductive Member

Figure 10A:
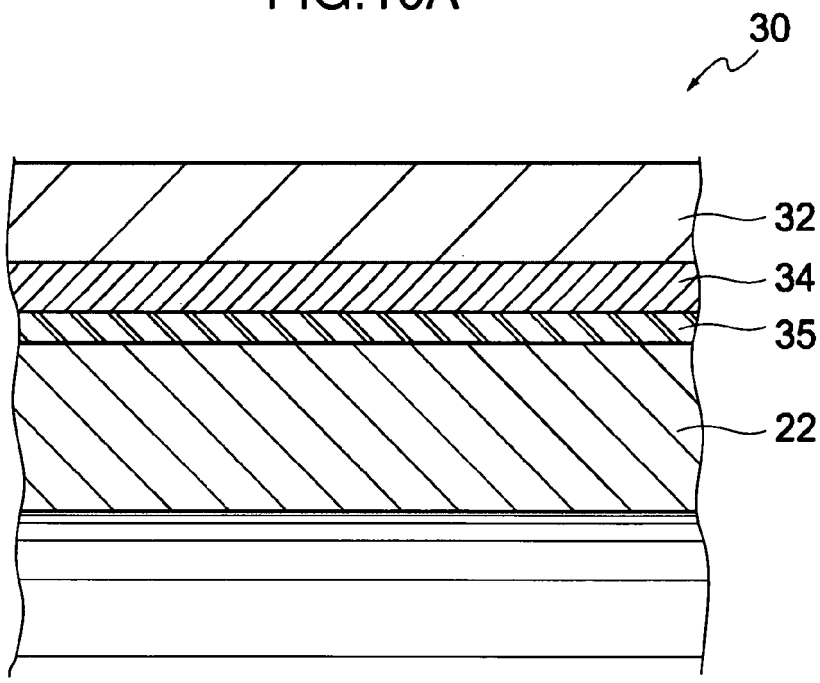
FIGS. 10A and 10B are views illustrating a laminated photoconductive layer formed on the base tube.

In producing the electrophotographic photoconductive member in the present embodiment, the photoconductive layer may be preferably a laminated photoconductive layer 30 of a charge-generating layer 34 containing a charge generating agent and a charge carrying layer 32 containing a charge carrying agent and a binder resin, as shown in FIG. 10A.

The laminated-layer electrophotographic photoconductive member 30 is produced by forming a charge-generating layer 34 containing a charge generating agent on a particular base tube, base material 22, for example by means of vapor deposition or coating, coating a coating solution containing a charge carrying agent and a binder resin then on the charge-generating layer 34, and forming a charge carrying layer 32 by drying.

Figure 10B:
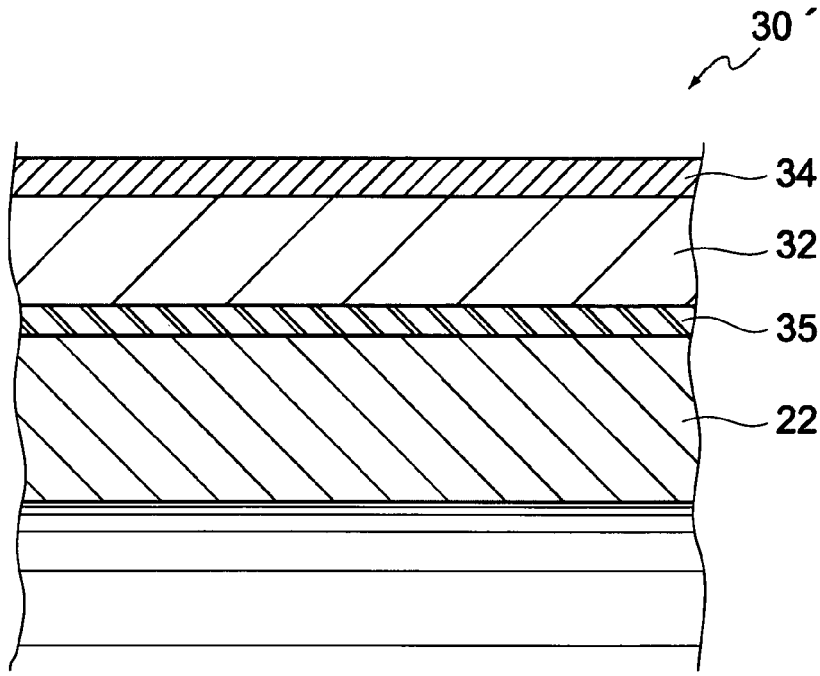
Figure 11A:
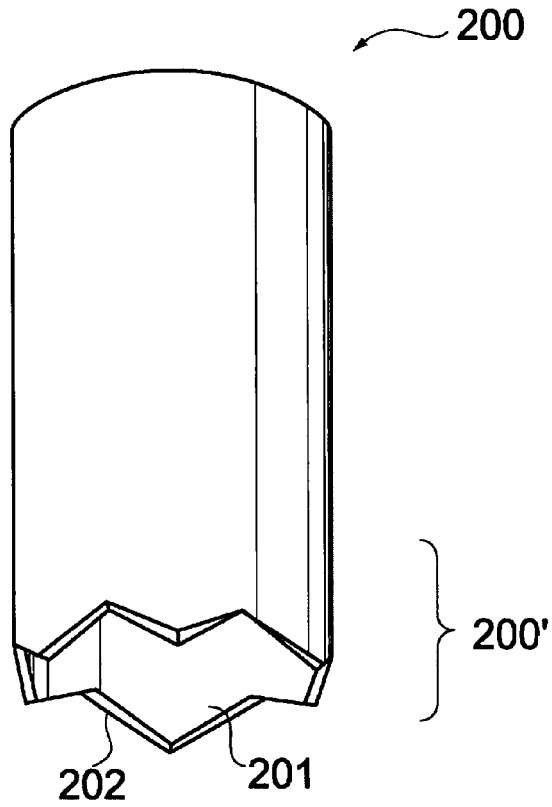
PRIOR ART FIG.11A
FIGS. 11A and 11B are partially perspective views illustrating conventional base tubes for an electrophotographic photoconductive member.
Figure 11B:
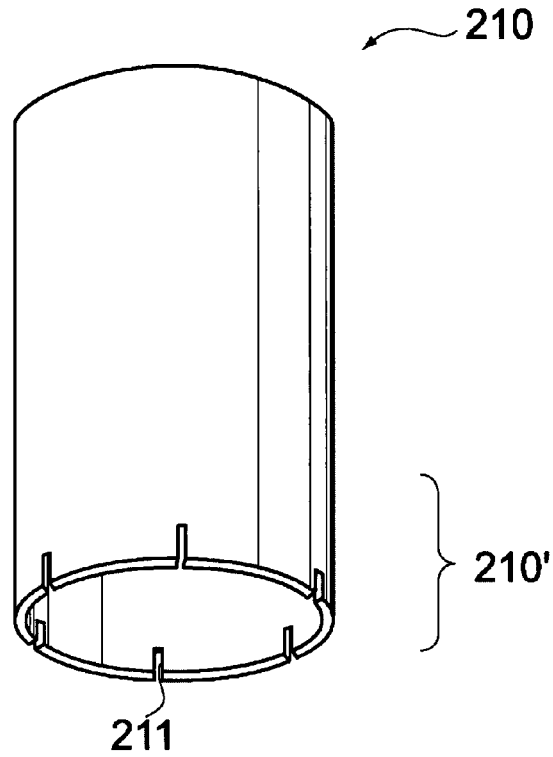
PRIOR ART FIG.11B

Differently from the structure described above, a charge carrying layer 32 and then a charge-generating layer 34 may be formed on the base material 22 as shown in FIG. 10B.

However, preferably for protection of the charge-generating layer 34, which is extremely thinner than the charge carrying layer 32, a charge carrying layer 32 is formed on the charge-generating layer 34, as shown in FIG. 10A. Similarly to the case of the single-layer photoconductive member, an intermediate layer 35 is also formed favorably on the base material 22.

The thickness of the photoconductive layer (charge-generating layer and charge carrying layer) in the laminated photoconductive layer 30 is not particularly limited, but the thickness of the charge-generating layer 34 is preferably within a range of 0.01 to 5 μm, more preferably within a range of 0.1 to 3 μm. Alternatively, the thickness of the charge carrying layer 32 is preferably within a range of 2 to 100 μm, more preferably within a range of 5 to 50 μm.

Third Embodiment

In the third embodiment, a method for producing an electrophotographic photoconductive member will be described in detail. The method for producing an electrophotographic photoconductive member in the present embodiment includes the steps of:

(a) forming a cylindrical base tube having a slanting portion on an end portion thereof, and the slanting portion slanting toward the end face of the end portion with respect to an axis of the cylindrical base tube and having an axial length of 0.3 to 5 mm;

(b) preparing a photoconductive-layer-coating solution containing a charge generating agent, a charge carrying agent, and a binder resin;

(c) immersing the cylindrical base tube into the photoconductive-layer-coating solution with the end portion having the slanting portion facing downward to coat the cylindrical base tube with the photoconductive-layer-coating solution;

(d) forming a photoconductive layer by drying the photoconductive-layer-coating solution coated on the peripheral surface of the cylindrical base tube; and (e) removing a part of the photoconductive layer on the end portion of the cylindrical base tube.

Hereinafter, the method for producing an electrophotographic photoconductive member in the third embodiment will be described by taking a single-layer electrophotographic photoconductive member as an example, excluding the description previously described in the first and second embodiments.

A charge-generating layer and a charge carrying layer are formed one by one also on the laminated-layer electrophotographic photoconductive member, similarly to the photoconductive layer of a single-layer electrophotographic photoconductive member.

1. Production of Base Tube

First, the base tube having a particular slanting portion previously described in the first embodiment is formed. By using such a base tube having a particular slanting portion, it is possible to prevent occurrence of liquid retention in the next photoconductive-layer-coating solution-coating step, and to obtain an electrophotographic photoconductive member having a photoconductive layer resistant to the bottom-end foaming caused by liquid retention and uniform in layer thickness.

The structure of the slanting portion is simple, and thus, the base tube having such a slanting portion can be produced very easily. It is also possible to raise the yield of the solvent used in photoconductive-layer-coating solution and also in bottom-end processing, and to shorten the drying period of the photoconductive layer.

The material for the base tube is not limited to a particular one, but a variety of materials may be used, for example, metals, surface-processed plastic materials, glass, and the like, as described above in the first embodiment.

The manner of forming the slanting portion on the base tube is not also to a particular one, but a variety of manners may be adopted, for example, machining. The uniform slanting portion can be easily formed, for example, by using a metal as the material for the base tube and by machining or cutting.

This is because the machining can be conducted readily, as an extensive operation of the conventional deburring or polishing operation, to the end portion of the base tube without any additional processing equipment.

2. Formation of Photoconductive Layer (1) Coating Step

A base tube is coated with a photoconductive-layer-coating solution as it is immersed therein with the end portion of its slanting portion facing downward. In this way, it is possible to prevent occurrence of liquid retention on the base tube having a particular slanting portion and to obtain an electrophotographic photoconductive member having a photoconductive layer resistant to the bottom-end foaming caused by the liquid retention and uniform in layer thickness.

Here, the coating step will be described more specifically, with reference to FIG. 3. A photoconductive-layer-coating solution 102 is placed in the coating solution tank 101 of a coating equipment 100. The base tube 10 is then immersed to be coated with its slanting portion 13 end portion 10' facing downward. The base tube 10 is lifted up.

The sealing stopper 14 is connected to the other end portion 10" of the base tube 10 for prevention of the penetration of the photoconductive-layer-coating solution 102 into the internal space of the base tube 10.

The photoconductive-layer-coating solution for use is prepared, for example, by mixing and dispersing particular components such as charge generating agent, charge carrying agent, and binder resin in a dispersion medium, for example, in a roll mill, ball mill, attriter, paint shaker, ultrasonic dispersing machine, or the like.

Various organic solvents are usable as the solvent for preparing the photoconductive-layer-coating solution. Examples there of include alcohols such as methanol, ethanol, isopropanol, and butanol; aliphatic hydrocarbons such as n-hexane, octane, and cyclohexane; aromatic hydrocarbons such as benzene, toluene, and xylene; halogenated hydrocarbons such as dichloromethane, dichloroethane, chloroform, carbon tetrachloride, and chlorobenzene; ethers such as dimethylether, diethylether, tetrahydrofuran, ethylene glycol dimethylether, diethylene glycol dimethylether, dioxane, and dioxolane; ketones such as acetone, methylethylketone, and cyclohexanone; esters such as ethyl acetate, and methyl acetate; amides such as dimethylformaldehyde, dimethylformamide, and dimethylsulfoxide; and the like, and these solvents may be used alone or in combination of two or more.

The viscosity of the photoconductive-layer-coating solution used (measurement temperature: 25° C., the same shall apply hereinafter) is preferably within a range of 50 to 1000 mPa·s.

It is because it is possible to prevent liquid retention and bottom-end foaming more effectively by adjusting the viscosity of the photoconductive-layer-coating solution within a range of 50 to 1000 mPa·s.

It is because it is possible to prevent liquid retention and bottom-end foaming effectively but difficult to form a photoconductive layer having a particular layer thickness, when the viscosity of the photoconductive-layer-coating solution is less than 50 mPa·s. On the other hand, when the viscosity of the photoconductive-layer-coating solution is more than 1000 mPa·s, the liquid retention and bottom-end foaming occur more frequently, and it becomes harder to disperse the charge generating agent, the charge carrying agent, and others sufficiently in the photoconductive-layer-coating solution.

Therefore, the viscosity of the photoconductive-layer-coating solution is more preferably within a range of 70 to 900 mPa·s, still more preferably within a range of 100 to 800 mPa·s.

(2) Drying Step

A photoconductive layer is formed by drying the photoconductive-layer-coating solution coated on the peripheral surface of the base tube. In this way, it is possible to vaporize the organic solvent contained in the photoconductive-layer-coating solution coated on the peripheral surface of the base material and solidify the photoconductive-layer-coating solution.

In the drying step, the solution is preferably dried, for example, at a drying temperature of 60° C. to 150° C. in a high temperature dryer, reduced-pressure dryer, or the like. It is because a drying temperature of less than 60° C. may elongate the drying period drastically and make it difficult to form a uniform-thickness photoconductive layer efficiently. Alternatively, a drying temperature of more than 150° C. leads to thermal decomposition of the photoconductive layer.

(3) Bottom end Processing Step

The photoconductive layer at the end portion of the base tube carrying a photoconductive layer is removed partially.

In this way, it is possible to remove the photoconductive layer at the bottom end by solubilization, by immersing the photoconductive layer at the bottom end of the base tube, which is previously immersed to be coated with the photoconductive-layer-coating solution, in a good solvent. By partial removal of the photoconductive layer, it becomes possible to connect a flange hanging an earth plate, conductively to the end portion of the base tube. In addition, it is also aimed at removing the layer photoconductive layer having an uneven layer thickness formed in the slanting portion.

The method for immersing it in solvent is the same as that for application of the photoconductive-layer-coating solution described above. Examples of the solvents for use in the bottom-end processing include the organic solvents for the photoconductive-layer-coating solution described above.

EXAMPLES

Example 1

1. Preparation of Base Tube

First, an aluminum base tube having a length in the axis direction of 254 mm, a diameter of 30 mm, and a thickness of 0.75 mm was formed. A slanting portion was then formed on the aluminum base tube by machining. More specifically, the slanting portion was formed in an end face processing machine, by rotating the aluminum base tube around its axis, pressing a machining bit to an end portion of the revolving aluminum base tube. The slanting portion had a base-tube length, as projected in the axis, of 3 mm, and an angle to the axis of 6°, and an extreme end thickness of 0.45 mm. The length of the slanting portion and the thickness of the extreme end were determined by using a vernier caliper, while the angle in the slanting portion was calculated from the length of the slanting portion, the thickness of the extreme end, and the thickness of the base tube.

2. Preparation of Photoconductive-Layer-Coating Solution (1) Photoconductive-Layer-Coating Solution having a Viscosity of 200 mPa·s 100 wt parts of a binder resin bisphenol Z-type polycarbonate resin having a weight-average molecular weight of 30000, 2.7 wt parts of a charge-generating substance, X-type nonmetal phthalocyanine, 50 wt parts of a positive hole carrying agent stilbene amine compound, 35 wt parts of an electron carrying agent azo quinone compound, and 700 wt parts of tetrahydrofuran were placed in an agitating container; and the mixture was blended and dispersed in a ball mill for 50 hours, to give a photoconductive-layer-coating solution having a viscosity of 200 mPa·s (measurement temperature: 25° C.).

The viscosity of the photoconductive-layer-coating solution obtained was determined by using a type-B viscometer (manufactured by Tokyo Keiki Co., Ltd.).

(2) Photoconductive-Layer-Coating Solution Having a Viscosity of 500 mPa·s 100 wt parts a binder resin, bisphenol Z-type polycarbonate resin having an weight-average molecular weight of 30000, 2.7 wt parts of a charge-generating substance X-type nonmetal phthalocyanine, 50 wt parts of a positive hole carrying agent stilbene amine compound, 35 wt parts of an electron carrying agent azo quinone compound, and 600 wt parts of tetrahydrofuran were placed in an agitating container; and the mixture was blended and dispersed in a ball mill for 50 hours, to give a photoconductive-layer-coating solution having a viscosity of 500 mPa·s (measurement temperature: 25° C.).

3. Formation of Photoconductive Layer

Subsequently, the base tube prepared was immersed in and lifted up from the photoconductive-layer-coating solution having a viscosity of 200 mPa·s at a speed of 3 mm/second with its slanting portion end portion facing downward and with a sealing stopper connected to the top end portion of the base tube, to coat the photoconductive-layer-coating solution on the base tube.

Then, the base tube carrying the coated photoconductive-layer-coating solution was dried under the condition of 130° C. for 45 minutes, to give a single-layer electrophotographic photoconductive member having a layer thickness of 30 μm.

Separately, a photoconductive-layer-coating solution having a viscosity of 500 mPa·s was coated on another base tube similarly prepared by a method similar to that described above, except that the base tube was immersed in and lifted up from the photoconductive-layer-coating solution at a speed of 1 mm/second. The photoconductive-layer-coating solution was dried under a condition similar to that described above, to give a single-layer electrophotographic photoconductive member b having a layer thickness of 35 μm.

4. Evaluation

Subsequently, 1000 single-layer electrophotographic photoconductive members a and b described above were prepared respectively for evaluation of the bottom-end foaming frequency. Among the single-layer electrophotographic photoconductive members obtained, the number of the single-layer electrophotographic photoconductive members with bottom-end foaming was counted. The results are summarized in Table 1.

Example 2

In Example 2, a base tube was prepared in a similar manner to Example 1, except that a base tube carrying a slanting portion having a length of 2.0 mm, an axis-line angle of 11°, and an extreme end thickness of 0.45 mm was prepared and a single-layer electrophotographic photoconductive member was prepared with the base tube and evaluated. The results are summarized in Table 1.

Example 3

In Example 3, a base tube was prepared in a similar manner to Example 1, except that a base tube carrying a slanting portion having a length of 210 mm, an axis-line angle of 17°, and an extreme end thickness of 0.45 mm was prepared and a single-layer electrophotographic photoconductive member was prepared with the base tube and evaluated. The results are summarized in Table 1.

Example 4

In Example 4, a base tube was prepared in a similar manner to Example 1, except that a base tube carrying a slanting portion having a length of 0.5 mm, an axis-line angle of 31°, and an extreme end thickness of 0.45 mm was prepared and a single-layer electrophotographic photoconductive member was prepared with the base tube and evaluated. The results are summarized in Table 1.

Comparative Example 1

In Comparative Example 1, a base tube was prepared in a similar manner to Example 1, except that a base tube carrying a slanting portion having a length of 0.2 mm, an axis-line angle of 56°, and an extreme end thickness of 0.45 mm was prepared and a single-layer electrophotographic photoconductive member was prepared with the base tube and evaluated. The results are summarized in Table 1.

Comparative Example 2

In Comparative Example 2, a base tube was prepared in a similar manner to Example 1, except that a base tube carrying a slanting portion having a length of 8.0 mm, an axis-line angle of 2°, and an extreme end thickness of 0.45 mm was prepared and a single-layer electrophotographic photoconductive member was prepared with the base tube and evaluated. The results are summarized in Table 1.

TABLE 1

| | SLANTING PORTION | | | NUMBER OF BODIES WITH BOTTOM-END FOAM | |
|---|---|---|---|---|---|
| | LENGTH (mm) | ANGLE (°) | END THICKNESS (mm) | VISCOSITY 200 mPa · s | VISCOSITY 500 mPa · s |
| EXAMPLE 1 | 3.0 | 6 | 0.45 | 0 | 0 |
| EXAMPLE 2 | 2.0 | 11 | | 0 | 0 |
| EXAMPLE 3 | 1.0 | 17 | | 0 | 2 |
| EXAMPLE 4 | 0.5 | 31 | | 2 | 20 |
| COMPARATIVE EXAMPLE 1 | 0.2 | 56 | | 50 | 100 |
| COMPARATIVE EXAMPLE 2 | 8.0 | 2 | | 10 | 40 |

As described above, the inventive base tube for an electrophotographic photoconductive member, which has the slanting portion having the particular length at the end portion, prevents liquid retention at the end portion of the base tube and bottom-end foaming caused by the liquid retention effectively.

The inventive electrophotographic photoconductive member and the inventive production method, which use the inventive base tube for an electrophotographic photoconductive member described above as the base part, has a photoconductive layer resistant to the bottom-end foaming caused by liquid retention and uniform in layer thickness easily.

Accordingly, the base tube for an electrophotographic photoconductive member, and the electrophotographic photoconductive member and the method for producing an electrophotographic photoconductive member using the same according to the present invention are considerably valuable in improving the production efficiency of various image forming apparatuses, such as copying machine and printer, and the image properties thereby.

Inventions in the following configurations are included in the typical embodiments described above: According to an aspect of the present invention.

An inventive base tube for an electrophotographic photoconductive member, comprises: a cylindrical body on which a photoconductive layer is formed; and a first slanting portion formed on a peripheral surface of an end portion of the cylindrical body, and slanting inward toward an end face with respect to an axis of the cylindrical body, an axial length of the first slanting portion of the cylindrical body being within a range of 0.3 to 5 mm.

In the configuration, it is possible to prevent occurrence of liquid retention effectively and make the photoconductive-layer-coating solution fall away smoothly downward, with a particular slanting portion formed on a peripheral surface of an end portion of the cylindrical body. It is thus possible to prevent the bottom-end foaming caused by liquid retention, improve the uniformity of the layer thickness of the photoconductive layer, and improve the yield of the photoconductive-layer-coating solution and the solvent used in bottom-end processing. The length of the slanting portion is determined, for example, by using a vernier caliper.

In the configuration above, the angle of the first slanting portion with respect to the axis of the cylindrical body may be preferably within a range of 5 to 40°. It is possible in this way to prevent occurrence of liquid retention more reliably and also the bottom-end foaming caused by the liquid retention further more reliably.

In the configuration above, the first slanting portion may preferably have a groove formed in the slanting surface. In this way, the photoconductive-layer-coating solution after application flows into the groove selectively, forcing the photoconductive-layer-coating solution to fall away more efficiently.

In the configuration above, the thickness of the extreme end of the end portion of the first slanting portion may be preferably within a range of 0.3 to 2 mm. It is possible in this way to prevent occurrence of liquid retention more effectively and retain the strength of the end portion of the base tube sufficiently.

In the configuration above, the base tube may preferably have a second slanting portion formed on an internal surface of the end portion and slanting outward toward the end face additionally. In this way, it is possible to prevent liquid retention of the photoconductive-layer-coating solution deposited on the internal surface of the base tube.

An inventive electrophotographic photoconductive member, comprises a base tube for an electrophotographic photoconductive member; and a photoconductive layer containing a charge generating agent, a charge carrying agent, and a binder resin, and formed on a peripheral surface of the base tube. The base tube includes a cylindrical body on which a photoconductive layer is formed, and a first slanting portion formed on a peripheral surface of an end portion of the cylindrical body, and slanting inward toward the end face with respect to an axis of the cylindrical body, an axial length of the first slanting portion of the cylindrical body being within a range of 0.3 to 5 mm.

In the configuration above, it is possible, by using a base tube having a particular slanting portion as a base material, to obtain an electrophotographic photoconductive member having a photoconductive layer resistant to the bottom-end foaming caused by liquid retention and uniform in layer thickness. It is thus possible to form a high-quality image consistently with the inventive electrophotographic photoconductive member.

In the configuration, the base tube may have an additional intermediate layer containing a binder resin and formed between the base tube and the photoconductive layer.

In the configuration above, the photoconductive layer may be a single-layer photoconductive layer containing a charge generating agent, a charge carrying agent, and a binder resin.

Alternatively, the photoconductive layer may be a laminated photoconductive layer including a charge-generating layer containing a charge generating agent and a charge carrying layer containing a charge carrying agent and a binder resin.

An inventive method for producing an electrophotographic photoconductive member, comprises the steps of:

(a) preparing a cylindrical base tube having a slanting portion on an end portion thereof, and the slanting portion slanting toward the end face of the end portion with respect to an axis of the cylindrical base tube and having an axial length of 0.3 to 5 mm;

(b) preparing a photoconductive-layer-coating solution containing a charge generating agent, a charge carrying agent, and a binder resin;

(c) immersing the cylindrical base tube into the photoconductive-layer-coating solution with the end portion having the slanting portion facing downward to coat the cylindrical base tube with the photoconductive-layer-coating solution;

(d) forming a photoconductive layer by drying the photoconductive-layer-coating solution coated on the peripheral surface of the cylindrical base tube; and (e) removing a part of the photoconductive layer on the end portion of the cylindrical base tube.

In the configuration, it is possible by using a base tube having a particular slanting portion as a base part to prevent occurrence of liquid retention, and obtain an electrophotographic photoconductive member having a photoconductive layer fewer with bottom-end foaming caused by the liquid retention and uniform in layer thickness easily.

In addition, because the structure of the slanting portion is simple, the base tube having the slanting portion is produced very easily and cost-effectively. It is also possible to improve the yield of the photoconductive-layer-coating solution and the solvent used in bottom-end processing and also to shorten the drying period of the photoconductive layer.

In practicing the production method, a metal may be used as a material for the base tube in step (a) and the slanting portion may be formed by machining. It is possible in this way to form a uniform slanting portion easily and cost-effectively.

This application is based on patent application No. 2006-223477 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. A base tube for an electrophotographic photoconductive member, comprising:

a cylindrical body on which a photoconductive layer is formed; and a first slanting portion formed on a peripheral surface of an end portion of the cylindrical body, and slanting inward toward an end face of the end portion with respect to an axis of the cylindrical body, an axial length of the first slanting portion being within a range of 0.3 to 5 mm.

2. The base tube according to claim 1, wherein the angle of the first slanting portion with respect to the axis of the cylindrical body is within a range of 5 to 40°.

3. The base tube according to claim 1, further comprising a groove formed in the slanting surface of the first slanting portion.

4. The base tube according to claim 1, wherein the thickness of the extreme end of the first slanting portion is within a range of 0.3 to 2 mm.

5. The base tube according to claim 1, further comprising a second slanting portion formed on an internal surface of the end portion of the cylindrical body, and slanting outward toward the end face.

6. An electrophotographic photoconductive member, comprising:

a base tube for an electrophotographic photoconductive member; and a photoconductive layer containing a charge generating agent, a charge carrying agent, and a binder resin, and formed on a peripheral surface of the base tube, wherein the base tube includes:

a cylindrical body on which a photoconductive layer is formed; and a first slanting portion formed on a peripheral surface of an end portion of the cylindrical body, and slanting inward toward the end face with respect to an axis of the cylindrical body, an axial length of the first slanting portion of the cylindrical body being within a range of 0.3 to 5 mm.

7. The electrophotographic photoconductive member according to claim 6, wherein the angle of the first slanting portion with respect to the axis of the cylindrical body is within a range of 5 to 40°.

8. The electrophotographic photoconductive member according to claim 6, further comprising a groove formed in the slanting surface of the first slanting portion.

9. The electrophotographic photoconductive member according to claim 6, wherein the thickness of the extreme end of the first slanting portion is within a range of 0.3 to 2 mm.

10. The electrophotographic photoconductive member according to claim 6, further comprising a second slanting portion formed on an internal surface of the end portion of the cylindrical body, and slanting outward toward the end face.

11. The electrophotographic photoconductive member according to claim 6, further comprising an intermediate layer containing a binder resin and formed between the base tube and the photoconductive layer.

12. The electrophotographic photoconductive member according to claim 6, wherein the photoconductive layer is a single-layer photoconductive layer containing a charge generating agent, a charge carrying agent, and a binder resin.

13. The electrophotographic photoconductive member according to claim 6, wherein the photoconductive layer is a laminated photoconductive layer including a charge generating layer containing a charge generating agent and a charge carrying layer containing a charge carrying agent and a binder resin.

14. A method for producing an electrophotographic photoconductive member, comprising the steps of:

(a) preparing a cylindrical base tube having a slanting portion on an end portion thereof, and the slanting portion slanting toward the end face of the end portion with respect to an axis of the cylindrical base tube and having an axial length of 0.3 to 5 mm;

(b) preparing a photoconductive-layer-coating solution containing a charge generating agent, a charge carrying agent, and a binder resin;

(c) immersing the cylindrical base tube into the photoconductive-layer-coating solution with the end portion having the slanting portion facing downward to coat the cylindrical base tube with the photoconductive-layer-coating solution;

(d) forming a photoconductive layer by drying the photoconductive-layer-coating solution coated on the peripheral surface of the cylindrical base tube; and (e) removing a part of the photoconductive layer on the end portion of the cylindrical base tube.

15. The method for producing an electrophotographic photoconductive member according to claim 14, wherein in the step (a), the cylindrical base tube is made of a metal and the slanting portion is formed by machining.

* * * * *